US005301094A

United States Patent [19]

Rodriguez, Jr.

[11] Patent Number: 5,301,094

[45] Date of Patent: Apr. 5, 1994

[54] LAMP CHANGING ASSEMBLY FOR OVERHEAD PROJECTOR

[75] Inventor: Ernesto M. Rodriguez, Jr., Austin, Tex.

[73] Assignee: Minnesota Mining and Manufacturing Company, St. Paul, Minn.

[21] Appl. No.: 32,507

[22] Filed: Mar. 17, 1993

[51] Int. Cl.[5] ..... F21V 19/04

[52] U.S. Cl. ..... 362/254; 362/20

[58] Field of Search ..... 362/20, 254, 285; 315/87

[56] References Cited

U.S. PATENT DOCUMENTS 4,410,929 10/1983 Feinbloom et al. ..... 362/254 X 4,975,810 12/1990 Vanderbel ..... 362/254 X

*Primary Examiner*—Stephen F. Husar

*Attorney, Agent, or Firm*—Gary L. Griswold; Walter N. Kirn; David W. Anderson

[57] ABSTRACT

A lamp changer assembly for an overhead projector includes a reflector bracket and a lamp support bracket mounting two lamps. The reflector mounting bracket includes a slot and the lamp support bracket has attached thereto a slide which rides in the slot. Contact between the end points of the slot and the slide determines the position of the lamps relative to the reflector bracket and the reflector mounted thereon.

3 Claims, 4 Drawing Sheets

LAMP CHANGING ASSEMBLY FOR OVERHEAD PROJECTOR

FIELD OF THE INVENTION

The present invention relates generally to overhead projectors and particularly to lamp changing mechanisms for such projectors.

BACKGROUND OF THE INVENTION

Overhead projectors are devices which produce magnified images on a screen or wall of indicia-bearing transparencies, typically clear plastic sheets including textual and/or graphical information. The projector includes a light source and a lens system which directs the light through the transparency to the screen for viewing by a group. The light source is typically a high-intensity lamp. These lamps generate significant heat and are thus relatively short lived.

In order to avoid a long delay in a presentation because of lamp failure, overhead projectors are typically supplied with a mechanism which includes two or more lamps, one of which is positioned for use and the other of which is retained as a spare. When the lamp in use fails, the user need only operate a knob or similar actuating device to remove the failed lamp from the use position and insert the spare lamp in its place.

Although lamp changing mechanisms have been designed which operated successfully, these mechanisms have typically been unduly complex and did not always achieve proper alignment of the lamps with the lens system of the projector.

SUMMARY OF THE INVENTION

The present invention produces a simplified lamp changer assembly which accurately positions its lamps within the projector by providing a reflector mounting bracket, a lamp support bracket for mounting at least two lamps in spaced, parallel relationship, the lamp support bracket being moveable relative to the reflector mounting bracket to position any of the lamps in predetermined relationship to the reflector mounting bracket, a slide mounting the lamp support bracket to the reflector mounting bracket, the slide being rigidly attached to the lamp support bracket and including a bearing surface for sliding contact with the reflector mounting bracket, the reflector mounting bracket further including a slot and the slide further including an extension extending into the slot to locate the slide with respect to the slot and the brackets with respect to each other, and a backing plate attached to the slide extension for retaining the slide extension within the slot. Preferably the slide and the backing plate are identical parts for economy of manufacture.

BRIEF DESCRIPTION OF THE DRAWINGS

The present invention will be more thoroughly described with respect to the attached drawings, wherein like numbers refer to like parts in the several views, and wherein.

DESCRIPTION OF THE PREFERRED EMBODIMENT

Figure 1:
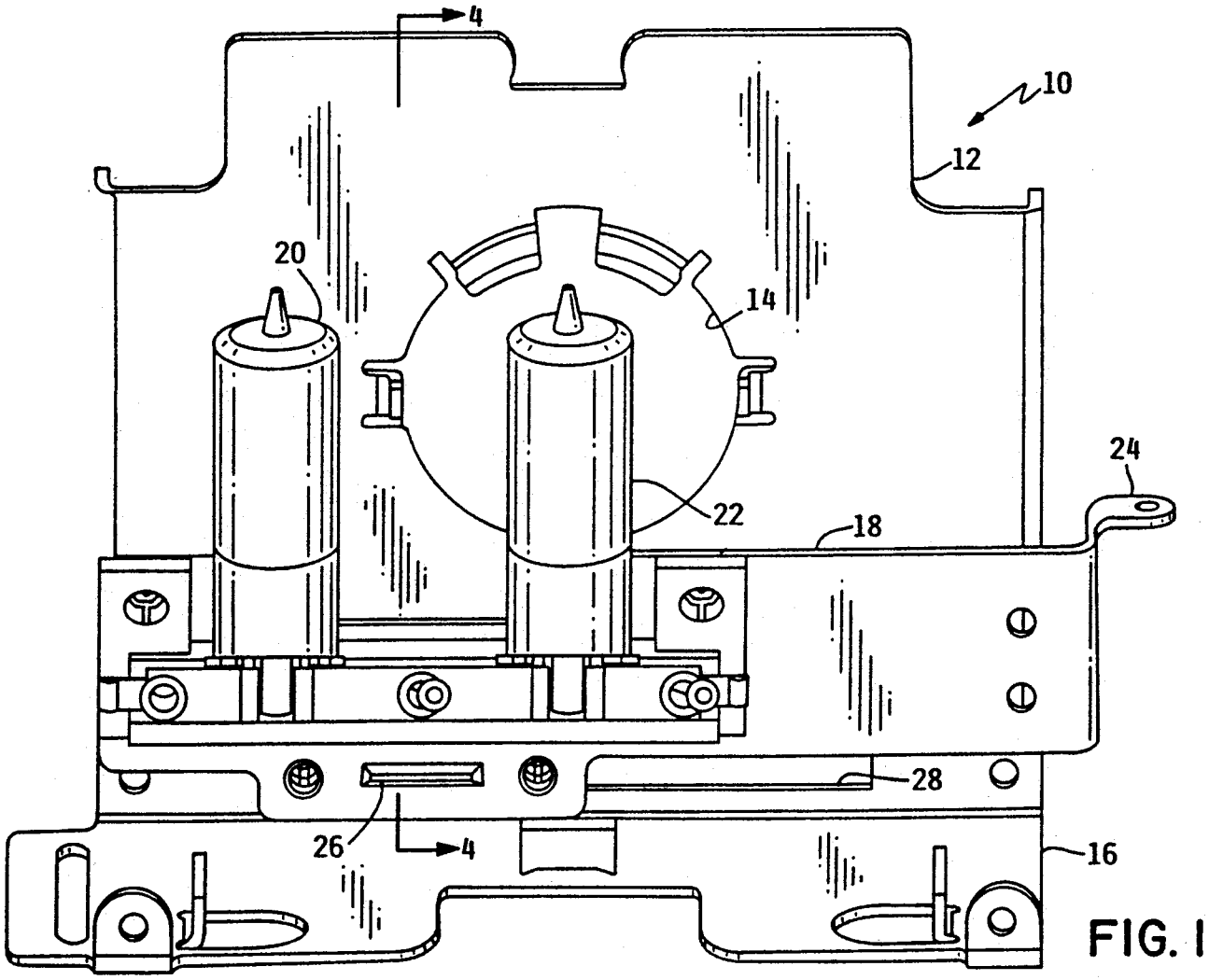
FIG. 1 is an elevational view of a lamp changer assembly according to the present invention.

FIG. 1 illustrates a lamp changer assembly, generally indicated as 10, according to the present invention which is adapted to fit within a conventional overhead projector (not shown) and provide a means for rapidly replacing a failed lamp with a spare lamp. The lamp changer assembly 10 includes a reflector mounting bracket 12 having a hole 14 in which a reflector for the lamps may be mounted. The reflector mounting bracket 12 further includes a mounting foot 16 which allows the reflector mounting bracket 12 to be attached to the overhead projector.

Attached to the reflector mounting bracket 12 is a lamp support bracket 18 mounting two lamps 20 and 22. The lamp support bracket 18 includes an attachment lug 24 which is connected to a conventional linkage arrangement extending to a knob or other termination which may be grasped and manipulated by the user of the projector to operate the lamp changer assembly 10.

Figure 2:
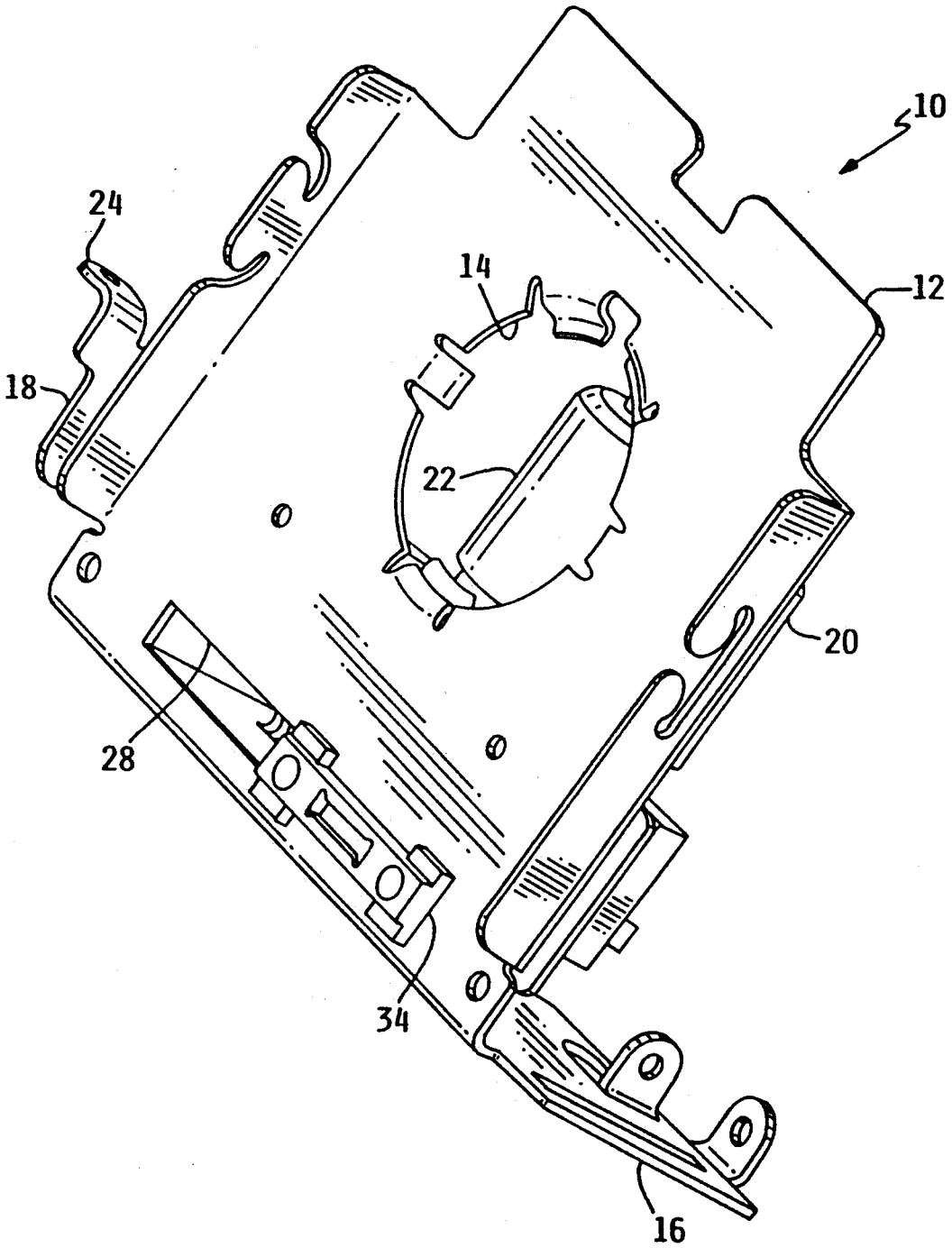
FIG. 2 is a perspective view of the lamp changer assembly of FIG. 1.
Figure 3:
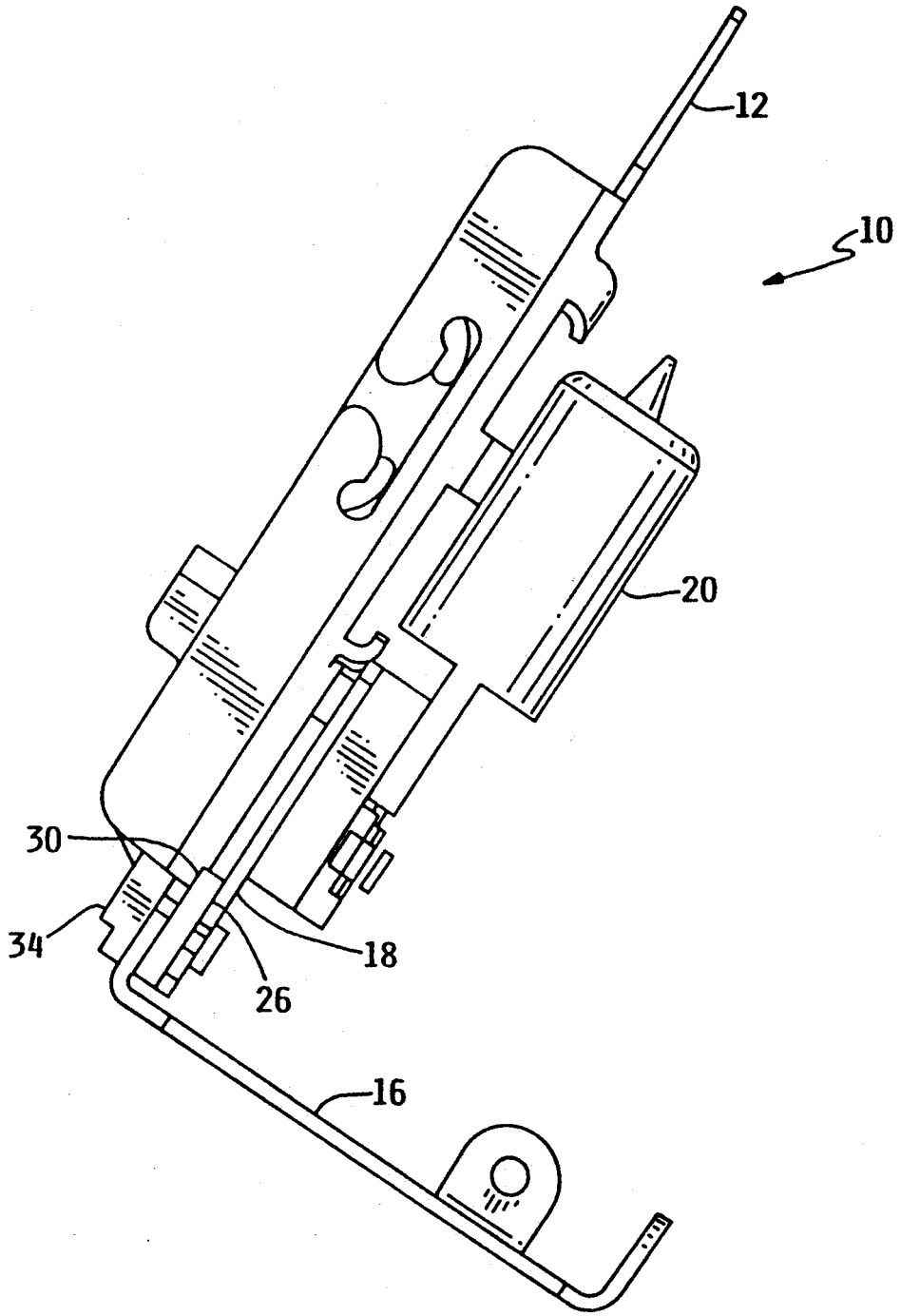
FIG. 3 is a side elevational view of the lamp changer assembly of FIG. 1.
Figure 4:
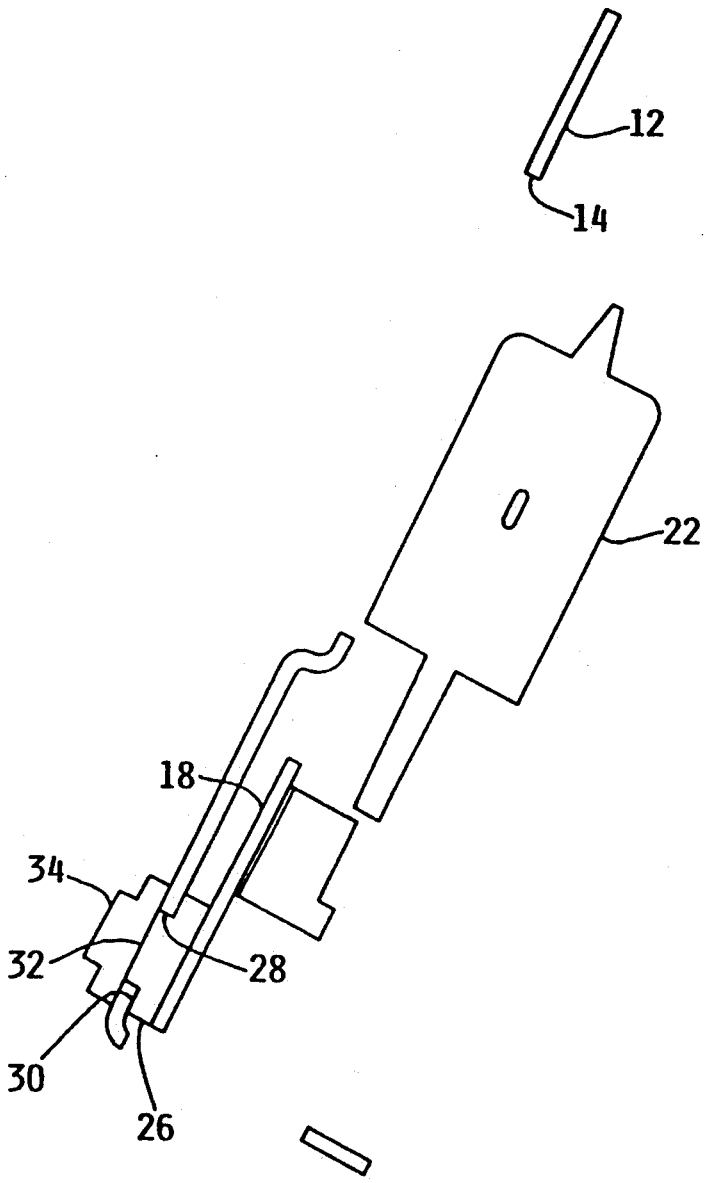
FIG. 4 is a cross-sectional view of the lamp changer assembly of FIG. 1 taken generally along the line 4—4 of FIG. 1.

As best seen in FIGS. 2–4, the lamp support bracket 18 is connected to the reflector mounting bracket 12 by a slide 26 which fits into a slot 28 formed in the reflector mounting bracket 12. The slide 26 includes a bearing surface 30 which is wider than the width of the slot 28 and an extension 32 projecting into the slot 28 to locate the slide 26 with respect to the slot 28 and thus the lamp support bracket 18 with respect to the reflector mounting bracket 12. A backing plate 34 is provided to retain the slide 26 within the slot 28. The slide 26 is attached to the lamp support bracket 18 and the backing plate 34 by fasteners 36 which extend through clearance holes in the slide 26 and the backing plate 34 to contact the lamp support bracket 18. The fasteners 36 are preferably self-tapping screws for direct connection to the lamp support bracket 18, but may be other fasteners such as rivets or bolts and associated nuts.

The backing plate 34 may simply be a flat sheet, but it is preferred to use a piece which is identical to the slide 26 for reasons of manufacturing economics. The slide 26 is thus provided with a recess opposite the extension 32 to accommodate the extension 32 of its mating piece. The materials of which the slide 26 is produced are preferably self-lubricating plastics such as polymeric amides or polycarbonates.

Since the slide 26 extends through the slot 28 of the reflector mounting bracket 12, the length of travel of the lamp support bracket 18 relative to the reflector mounting bracket 12 will be determined by the length of the slot 28, and the positions at which the lamps 20 and 22 stop relative to the reflector mounted on the reflector mounting bracket 12 will be determined by the end points of the slot 28. Thus positioning of the lamps 20 and 22 is determined with great precision.

Thus there has been described a lamp changing mechanism which is simple in construction and highly accurate in operation. Although the invention has been described with respect to only a singly embodiment, many modifications will be apparent to those skilled in the art. For example, the slide 26 could assume a variety of shapes so long as it includes an extension 32 extending into the slot 28 and a bearing surface 30 on both sides of the extension 32 to contact the reflector mounting bracket 12.

I claim:

1. A lamp changing assembly comprising:

a reflector mounting bracket;

a lamp support bracket for mounting at least two lamps in spaced, parallel relationship, said lamp support bracket being moveable relative to said reflector mounting bracket to position any of said lamps in predetermined relationship to said reflector mounting bracket;

a slide mounting said lamp support bracket to said reflector mounting bracket, said slide being rigidly attached to said lamp support bracket and including a bearing surface for sliding contact with said reflector mounting bracket;

said reflector mounting bracket further including a slot and said slide further including an extension extending into said slot to locate said slide with respect to said slot and said brackets with respect to each other; and a backing plate attached to said slide extension for retaining said slide extension within said slot.

2. A lamp changing assembly according to claim 1 wherein said slide and said backing plate are substantially identical and are connected to each other to capture said reflector mounting bracket therebetween.

3. A lamp changing assembly according to claim 1 wherein said assembly includes two lamps, said slot includes two ends and contact between said slide and said slot ends positions one or the other of said lamps in said predetermined relationship to said reflector mounting bracket.

* * * * *